US005752336A

United States Patent [19]

Haynes

[11] Patent Number: 5,752,336

[45] Date of Patent: May 19, 1998

[54] DISPLAY CASE AND DISPLAY FOR GAME AND COLLECTOR ARTICLES

[76] Inventor: Richard B. Haynes, 331 Soquel Ave., Suite 203, Santa Cruz, Calif. 95082

[21] Appl. No.: 444,299

[22] Filed: May 18, 1995

[51] Int. Cl.[6] ..... A63F 9/10

[52] U.S. Cl. ..... 40/323; 273/157 R; 40/642

[58] Field of Search ..... 40/323, 27.5, 642, 40/642.02; 206/445, 564, 0.82, 0.84, 45.31; 220/377, 387.1; 273/153 P, 156, 157 R, 157

[56] References Cited

U.S. PATENT DOCUMENTS

| | | | |
|---|---|---|---|
| D. 281,791 | 12/1985 | Dobrzynski | 273/157 R X |
| 482,639 | 9/1892 | Isch | 206/0.84 |
| 1,714,127 | 5/1929 | Graham | 273/157 R |
| 1,725,456 | 11/1929 | Garman | 273/157 R |
| 1,856,650 | 5/1932 | McLintock et al. | 273/157 R |
| 1,972,206 | 9/1934 | Thomay | 273/157 R |
| 2,985,284 | 5/1961 | Levy | 206/0.83 |
| 3,069,001 | 12/1962 | Burdick | 206/0.83 |
| 3,554,625 | 1/1971 | Sly | 206/0.83 |
| 4,097,308 | 6/1978 | Klein et al. | 206/445 X |

*Primary Examiner*—Cassandra Davis
*Attorney, Agent, or Firm*—Donald R. Boys

[57] ABSTRACT

A display carrier for POGS and/or Slammers has a body portion with an upper flat surface and registration cavities therein arranged in an upper and a lower level, such that POGS or Slammers registered in cavities in the lower level may be overlapped by POGS or Slammers registered in the cavities in the upper level. POGS and Slammers with picture elements may therein be placed and displayed to present a larger contiguous pictorial display. In one embodiment there is but one level of registration cavities, and picture elements are presented on the upper flat surface to form a composite pictorial display with picture elements on POGS or Slammers placed in the registration elements. In some embodiments transparent lids cooperate with the body portions to enclose and protect POGS and Slammers in the display carriers, and picture elements may be placed on the underside of lids to form parts of a composite picture with POGS or Slammers.

11 Claims, 7 Drawing Sheets

DISPLAY CASE AND DISPLAY FOR GAME AND COLLECTOR ARTICLES

FIELD OF THE INVENTION

The present invention is in the area of display cases and displays incorporating removable elements such as game tokens, wherein the tokens or other removable elements may be added to a partial display in a case to form a coherent display, or may of themselves form a display in a case or carrier when placed and arranged in a particular manner.

BACKGROUND OF THE INVENTION

It is well known that there are many popular pastimes associated primarily with children, but certainly not limited to children, and involving such as cards and/or tokens of several sorts, wherein the cards or tokens may have images printed or otherwise applied thereon. Baseball cards are a familiar example. Such cards typically bear the image of a baseball player, and often personal and/or professional annotation as well, such as the player's batting averages for particular seasons. Depending on the relative scarcity and desirability among those to whom such things are important, certain cards may come to be of considerable value.

Collectibles certainly are not limited to baseball cards, and the notion of and practice of collecting such articles is also very old in the art. A familiar pastime of old that provided an opportunity for collecting, for example, is the game of marbles. In this game, as is abundantly well known, especially to older citizens, glass spheres are used, and one generally tries to drive an opponents marbles out of marked ring through striking the opponents marbles with a special marble called a shooter. Marbles of all sorts have been produced in a variety of colors and patterns, and with a myriad of internal elements; and enthusiasts have long collected favorite marbles.

When an enthusiastic participant attaches special value to one or another, or to a series of articles, that participant will often desire to take special care in storing, transporting, and displaying the articles. Marble players often kept special bags for storing and transporting valued marbles, and in some cases the bags were (are) made of special materials, such as chamois or other leather materials. Baseball card collectors use carriers that are designed for both transporting and displaying valued cards. The card displays typically provide slip-in pockets in clear plastic carriers, so individual cards are individually protected and displayed.

Because of the perceived value of collectible articles to those who collect them, and to some other enthusiasts, some thought and ingenuity has been given to displays. Display carriers for such as baseball cards have been described above. Carriers of this sort have come to be used also for collectible cards of another sort, wherein the cards illustrate typically a portion of a larger scene. An example is cards that illustrate action scenes peopled by fictional characters, such as the Teenage Mutant Ninja Turtles™. There are many other examples of fictional, and in some cases, real characters that might be a incorporated into such scenery. Some of this is being done by Marvel™ comics, for example.

In displays of the sort described immediately above, providing such as action scenes, the general idea is to provide individual collectible cards, the cards being typically rectangular in shape, with each card having some recognizable figure or feature, in a manner that a preplanned grouping of the cards may be arranged together to form a larger picture wherein each of the individual figures and features play a part. One can imagine, then, composing an action scene of a size four times as long as a typical collectible card and four times as wide as well, wherein sixteen distinct figures or features are utilized in distinct portions of the overall scene. The overall scene is printed on card material and divided (cut) into sixteen individual cards, which can be used, or incorporated into a game, separately, each of the cards having one or more distinct and recognizable characters and/or features.

For cards of the sort just described, one may provide a carrier which is also a display, having individual compartments for the sixteen separate cards, so the individual cards may be placed for storage, transport, and display in separate compartments in the sequence that results in display of a larger, meaningful picture, which scene is not evident from the scenes of the individual cards.

Other than cards, such as baseball cards and other figure and scene cards as described above, there are many other cards and tokens associated with games or other pastimes that bear the common characteristic of becoming, to those who are interested, of special value, and of being associated or used together in a manner that admits of the characteristics of collectibles. Many of these sorts of articles, however, do not share the parallelogram shape of cards, which admit to forming larger scenes by placement side-by-side.

At the time of this specification an elite example of a game utilizing collectible tokens is the game of POGS, which was, according to information available to the present inventor, introduced in the state of Hawaii by an elementary schoolteacher who wished to show children in her charge how to play a simple game she remembered from her childhood.

The game of POGS apparently involved stacking milk bottle caps to an agreed-upon height, then "slamming" the stack or stacks, by alternate players, with a weighted cap. The object was to cause individual caps to land, after being slammed, on the side opposite the side on which they were originally stacked. Opposing players won the flipped caps, or the number of such caps could be counted as points in one or another scoring scheme.

This game has developed, at the time of this specification, into a marketing tsunami, involving growing numbers of manufacturers providing POGS and Slammers of many sorts. Also POGS and Slammers, like baseball cards and other collectible items are increasingly provided with images of many sorts printed or otherwise applied to one or both sides.

POGS, as opposed to card type game tokens and collectibles, are round, not rectangular. Being round, even though they provide a convenient surface for displaying images with action figures and features, that do not immediately provide for an obvious means of storage and display, incorporating individual figures and features into a larger, meaningful scene, which might enhance the value of the individual POGS and Slammers. What is clearly needed is a display carrier for POGS and/or Slammers, and for other such individual collectible articles that do not lend themselves to side-by-side placement as do cards, which allows individual figures and features on individual articles, and also allows the individual articles to be arranged in a way to provide a larger, integrated picture.

SUMMARY OF THE INVENTION

In a preferred embodiment, as a new article of manufacture, a display carrier for round, flat articles is provided, comprising a body portion with an upper flat surface having a first planar array of first round registration cavities therein with the first cavities having a common first depth from the upper flat surface equal to or greater than twice the thickness of one of the round, flat articles. A second planar array of second registration cavities overlays the array of first registration cavities, with the second registration cavities having a common second depth from the upper flat surface equal to about one-half the first depth. Individual ones of the second registration cavities are laterally offset from but overlap registration cavities of the first array, such that the summed area of all of the registration cavities viewed in a direction perpendicular to the plane of the upper flat surface, forms a contiguous common area.

In this arrangement, round, flat articles, such as POGS and Slammers, may be placed in the registration cavities selectively and with a preferred rotary orientation, so that a composite picture may be presented without gaps in the composite picture.

In an alternative embodiment only one level of registration cavities is provided, and picture elements to fill in gaps in a composite picture are placed on the upper flat surface. In some embodiments transparent lids are provided to attach to the body portion to retain and protect articles placed in the registration cavities. In some cases, picture elements may be placed on the lids to aid in forming a composite pictorial display.

The display carrier of the present invention provides collectors with a unique ability to display their collected items in a manner to present composite pictures too large and complex to be presented on a single article, and at the same time provides security and protection for the articles.

It is believed by the inventors that use of a display case according to one or another embodiments of the invention enhances the value of a collection of POGS and/or slammers, by providing a method of display not before available for such articles. In particular, assembling such round articles into a comprehensive and composite picture, wherein individual round articles bear a portion of the overall picture, is virtually impossible without a display case that registers the individual articles. Moreover, even a display case that registers, but that does not strictly orient the articles rotationally can be difficult to use. The display case provided herein offers an ability to strictly register and position round articles.

DESCRIPTION OF THE PREFERRED EMBODIMENTS

Figure 1B:
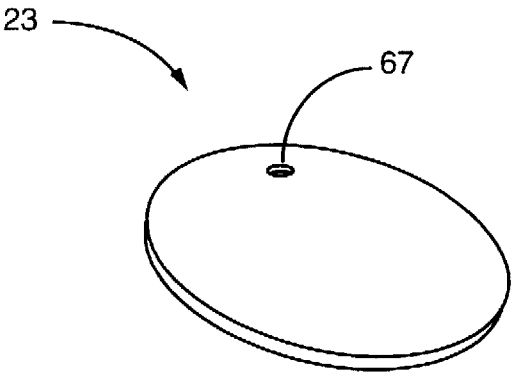
FIG. 1B is an isometric view of the POG of FIG. 1A, showing the side opposite the side visible in FIG. 1A.
Figure 1A:
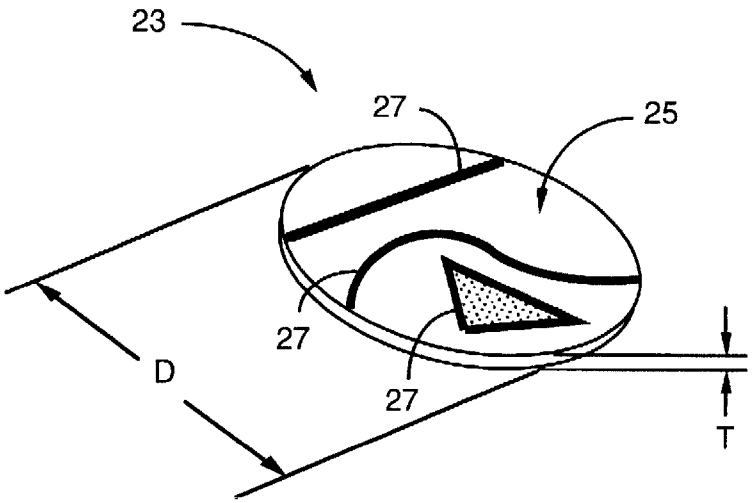
FIG. 1A is an isometric view of a POG, for which a display carrier according to the invention is provided.

FIG. 1A is an isometric view of a POG 23 with picture elements such as element 27 printed on a flat side 25. POG 23 has a diameter D and a thickness T. The picture elements have no clear and recognizable purpose on single POG 23 in this example, but form a part of a larger picture that may be presented by an array of POGS in a selected relationship. Diameter D is typically about 42.5 mm (about 1⅝ inches), and thickness T is typically about 1.6 mm (about 1/16 inch).

FIG. 1B is an isometric view of POG 23 of FIG. 1A showing the side opposite pictorial surface 25, and a small hole 67 having a purpose to be explained fully below. Hole 67 is about 0.8 mm in diameter, and does not pass through the thickness of the POG, but opens only to the one side.

Figure 2:
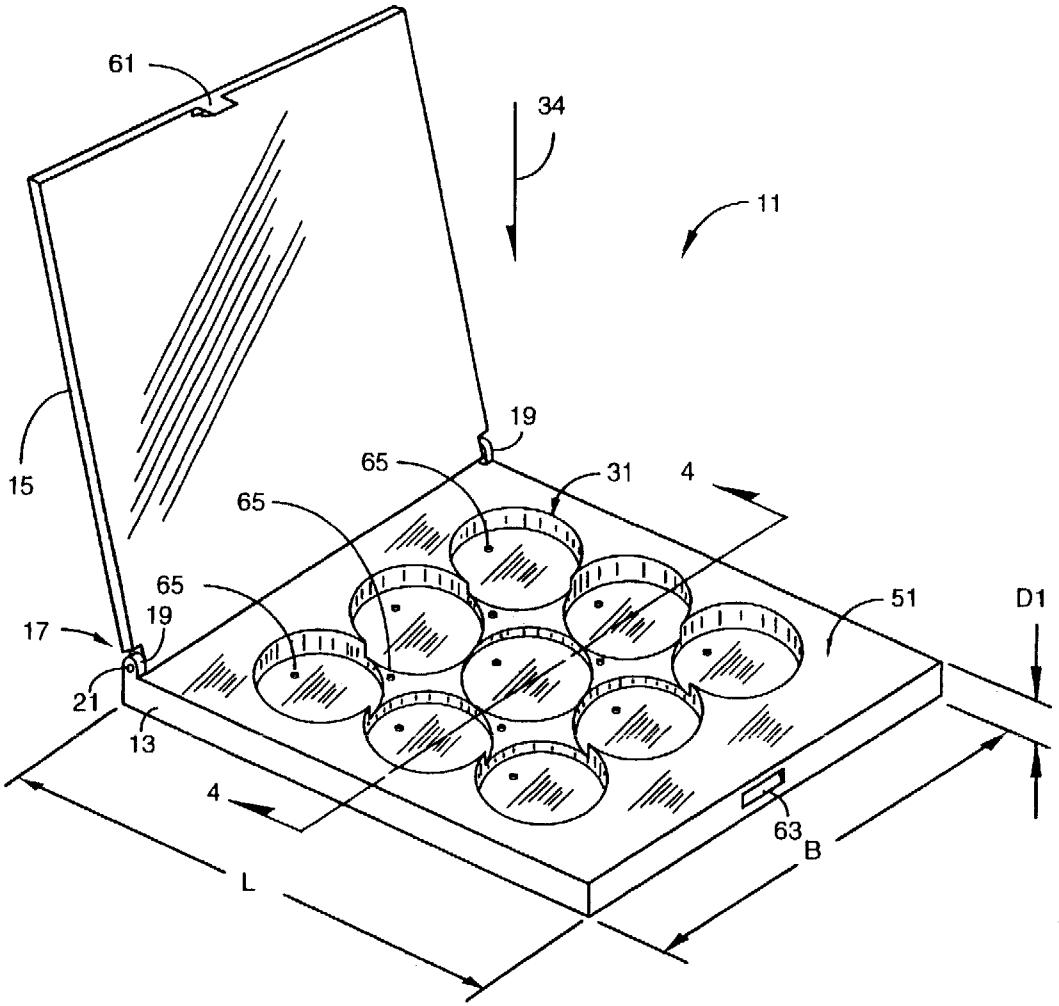
FIG. 2 is an isometric view of a display carrier according to a preferred embodiment of the invention, made to carry and display POGS such as the POG shown in FIG. 1A and 1B.

FIG. 2 is an isometric view of a display carrier 11 according to a preferred embodiment of the present invention, configured to carry and display thirteen round and flat articles (such as POGS and or Slammers) in a manner that the articles in the carrier may present an integral scene from individual features and figures on the surfaces of the individual articles.

Carrier 11 in the embodiment shown by FIG. 2 has a body portion 13 with a length L and a breadth B. In this example, L=B, and the body is square. A preferably transparent lid 15 is pivotally attached to body 13 by a hinge arrangement 17 comprising, in this embodiment, projections 19 on the body for engaging pins also engaged in holes in the lid. Each of projections 19 has a horizontal hole, and pins 21 engage the holes in both the lid and projections 19 when the lid is in place. It will be apparent to those with skill in the art that there are many conventional ways a secure and inexpensive hinge might be fashioned.

Figure 3:
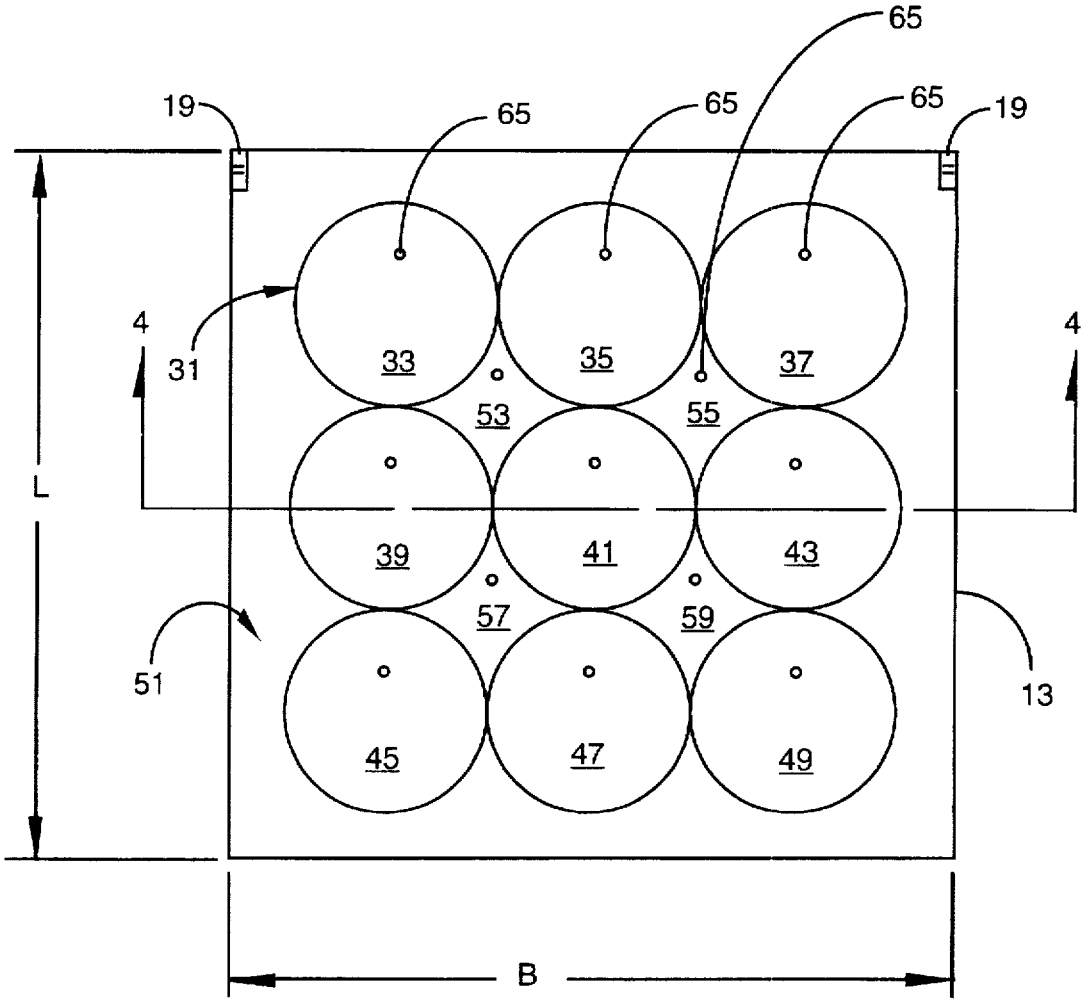
FIG. 3 is a plan view of a body portion of the display carrier of FIG. 2, showing placement of registration cavities for carrying POGS.

FIG. 3 is a plan view of body 13 in the direction of arrow 34 in FIG. 2. Nine cylindrical registration cavities 33, 35, 37, 39, 41, 43, 45, 47, and 49 are fashioned into body 13 to a depth of about twice the thickness of a POG; that is, to a depth=2T, or about 3.2 mm. These cavities are positioned in a Cartesian array, such that the diameters are tangent and lines drawn parallel to surface 51 through the centers of the nine registration cavities form a square matrix.

Figure 4:
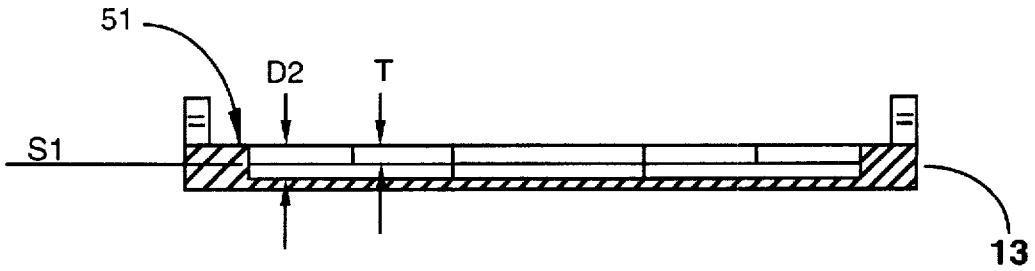
FIG. 4 is a cross section elevation of the body portion of FIG. 3, taken along section line 4—4 of FIG. 2 and FIG. 3.

FIG. 4 is a section elevation view of body 13 along section line 4—4 of FIG. 2 and FIG. 3. Depth D2 is the depth of each of the nine substantially cylindrical registration cavities described immediately above, in this example about 2T, or 3.2 mm.

Referring now to plan view FIG. 3, fashioning the nine cylindrical cavities leaves four areas 53, 55, 57, and 59 fully enclosed within the area of the nine bores. Area 53, for example, is bounded by portions of the circumference of each of cavities 33, 35, 39, and 41. In this embodiment, each of areas 53, 55, 57, and 59 is fashioned below the plane of surface 51 by a depth substantially equal to the thickness of a POG, T; or, in this embodiment, about 1.6 mm, as is shown in FIG. 4.

Cavities 33, 35, 37, 39, 41, 43, 45, 47, and 49 are fashioned to have a diameter just slightly larger than the diameter of a POG, in this example about 42.5 mm, and are for enclosing and positioning one POG each in the carrier, which then provides a nine POG planar array with the pictorial surfaces (see surface 25 of FIG. 1) in a plane at the level of surface S1 (FIG. 4). Areas 53, 55, 57, and 59 then provide four additional positions for placing POGS, so the carrier holds a total of thirteen POGS.

The material of body 13 in the embodiment illustrated is injection-moldable plastic, of which there are a number of suitable materials. In this embodiment the hinge projections and all of the cavities and features of the body are fashioned by the art of injection molding. Lid 15 is similarly injection molded from a transparent moldable material, with the hinge features and a closure clip 61 fashioned by the art of injection molding. A depression 63 is molded into body 13 to engage clip 61 when lid 15 is closed. It will be apparent to those with skill in the art that there are a variety of ways a suitable closure may be provided.

Figure 5:
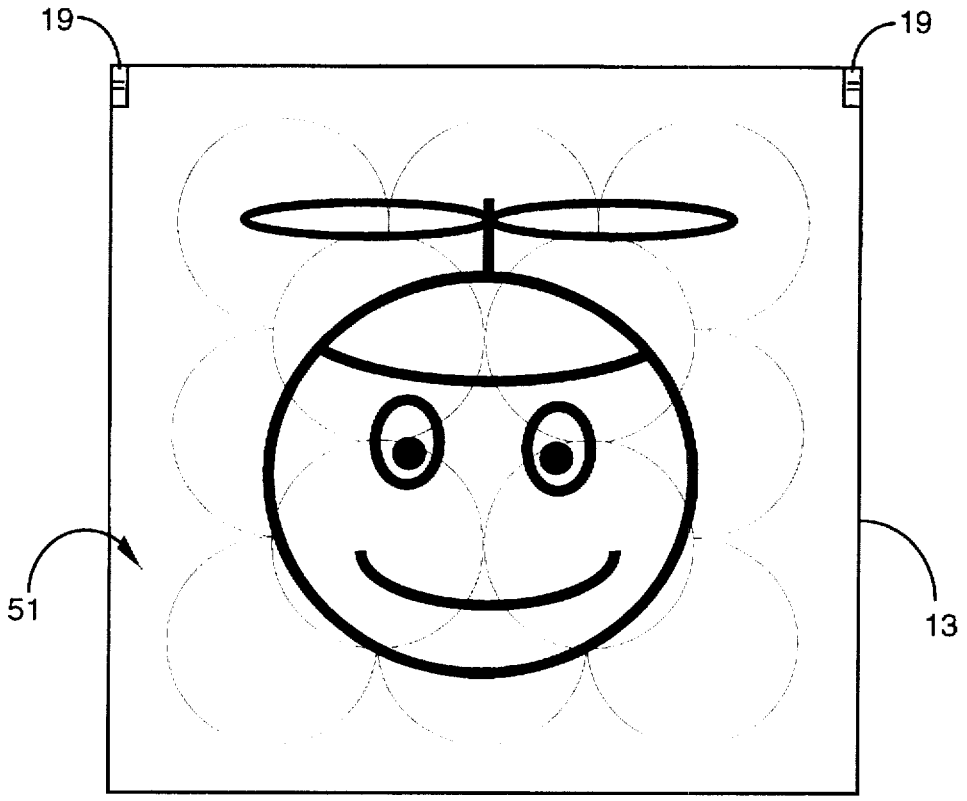
FIG. 5 is a plan view of the body portion of FIG. 3, showing POGS in place providing a composite picture.

FIG. 5 is a plan view of body 13, similar to the plan view of FIG. 3, but with thirteen POGS, such as POG 25 loaded into the thirteen carrier positions in the body. In FIG. 5 it is seen that the assembled array of the thirteen POGS in body 13 presents a picture of a happy face wearing a propeller cap. This particular assembled picture is merely exemplary of an infinite variety of pictures that might be presented.

In the plan view of FIG. 5, each pog in its own array position has on its pictorial surface either a portion of the overall picture or no picture elements at all. In more complicated pictures, all of the POGS could be expected to have picture elements.

In FIG. 5 the POGS occupying the four upper positions, directly over areas 53, 55, 57, and 59 (see FIG. 3), each have their diameteral outlines shown in the picture by light-weight lines for the purpose of demonstrating the portion of the overall picture each of these POGS presents. In actuality, in most cases, these outlines would either not be seen, or would be difficult to ascertain, as the features on one POG would tend to blend with the features of the underlying POGS.

If body 13 has just one array of cavities for nine POGS, such as the array of cavities 33, 35, 37, 39, 41, 43, 45, 47, and 49, and picture elements were provided only on the POGS and not on surfaces of carrier 13, there would be four areas having no picture elements, and a contiguous composite picture would not be presented. The unique two-level placement structure of carrier 13 in the embodiment of FIG. 5 overcomes this drawback and allows a contiguous composite picture to be displayed.

In the presentation of FIG. 5, it is seen that the four upper-level POGS partially overlap the nine lower-level POGS when all of the POGS are loaded into the display carrier of the invention. In this instance, some picture elements appearing on the upper POGS will hide the same picture elements on the pictorial surface of four lower POGS. That is, all of the pictorial surface of each POG may be devoted to picture elements, even though some portions of the lower POGS are obscured. The elements on the obscured portions are seen on the pictorial surfaces of the upper-level POGS.

Since the POGS in the present case are round, it is desirable that a system for angular orientation be included to render placement of the pictorial POGS in correct orientation to present the composite picture. In a preferred embodiment this system comprises pin-like projections fashioned in body 13 to be matched with holes in the surface opposite the pictorial surface of the POGS to be displayed. Individual pin-like projections 65 are illustrated in FIG. 2 and FIG. 3 for this purpose.

FIGS. 1A and 1B described above illustrate a unique POG for use in practicing the present invention. Small hole 67 shown in FIG. 1B is for the purpose of engaging one of pin-like projections 65 locating a POG 23 rotationally when the POG is placed in one of the thirteen POG positions in carrier 13.

There are a number of options for pin and hole positioning in different embodiments of the invention. For example, the pins and holes may be located at a common position for each of the POG positions. This is the example shown, with the pin located in each position at the twelve-o'clock position near the periphery of the cavity. In this case, one has the challenge of a jigsaw puzzle when loading POGS into the display carrier. The principle clue for placement in this embodiment is the pictorial presentation of each POG, and the user's foreknowledge of the composite picture. With a coherent picture and only thirteen pogs this should not be a problem.

In an alternative embodiment the placement of one or more engaging elements on POGS and the surfaces of body 13 may be unique for each POG position, so a user will have the position of the engaging elements as a clue to proper placement of the POGS in the carrier to form the composite picture.

As was described above, the picture of a smiling face is simple and merely exemplary. Much more detailed and complicated art may be presented. It is an object of the invention, in fact, to provide a display vehicle for many proprietary images, such as sports figures, cartoon characters, and comic-book characters, in a manner that individual characters and portions of an overall picture may appear on individual POGS, and composite art may be presented by a display carrier according to the present invention wherein several characters may be represented in an overall setting or scene.

Figure 6A:
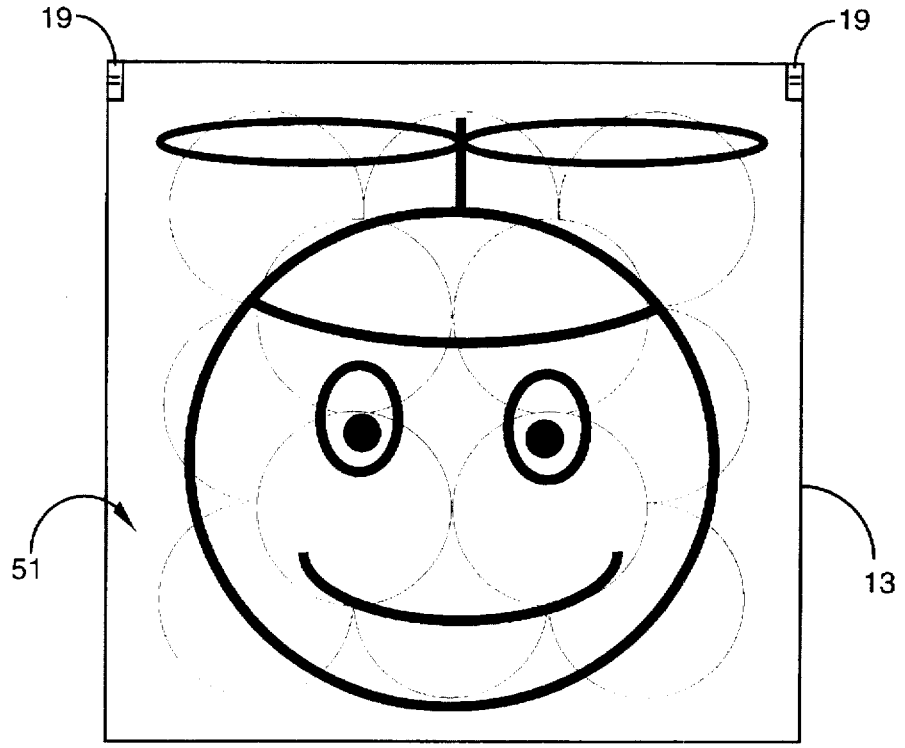
FIG. 6A is a plan view of another body portion with POGS, showing a composite picture including picture elements on portions of the body as well as on the POGS.
Figure 6B:
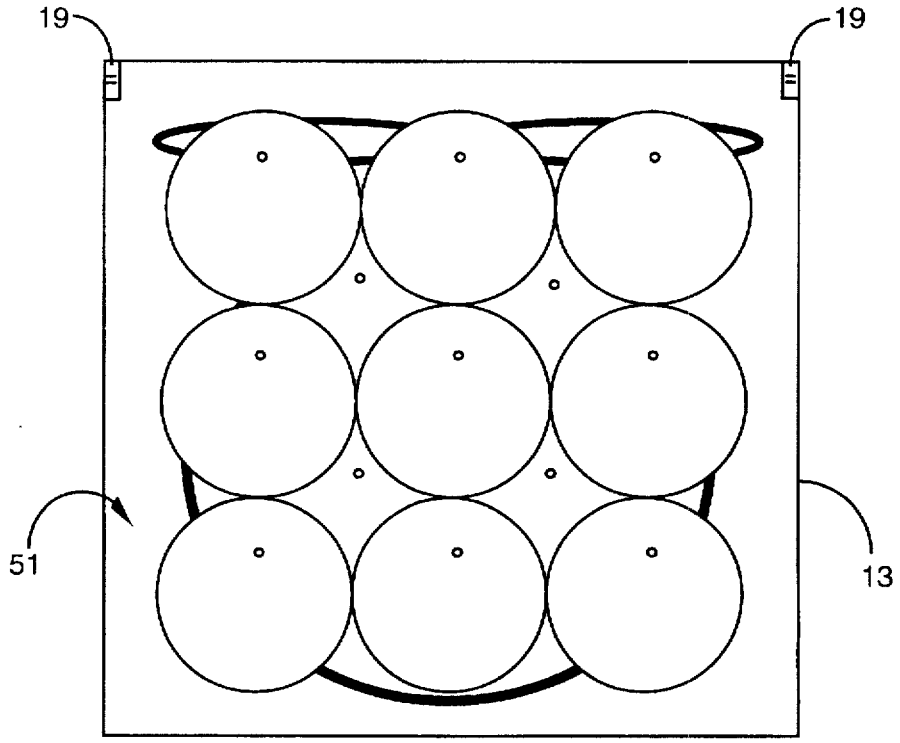
FIG. 6B is the plan view of FIG. 6A with the POGS removed.

It is not strictly required that pictorial elements be presented only on the pictorial surfaces of the POGS to be placed in a display carrier according to the invention. Parts of an overall picture may also be presented on upper surface 51 of body 13. Consider, for example, all of surface 51 presented in plan view FIG. 3 (and FIG. 5) where POGS do not appear. That is, all of this surface from the periphery of the POGS out to the edges of body 13. All of this area may be provided with a permanent background pictorial scene, which is filled in by placement of POGS in the cavities in the body portion of the carrier. FIG. 6A illustrates this situation, with a smiling face of a larger size than may be presented by the carrier of FIG. 5. Some of the elements of the smiling face in FIG. 6A are presented on permanent surfaces of body 13. FIG. 6B shows the POGS removed, so the elements on surface 51 may be clearly distinguished.

Such a permanent scene portion for surface 51 of body 13 may be provided in a number of ways known in the art, such as by attaching a pictorial overlay to surface 51 with an adhesive material. A scene might also be painted or printed on body 13, or even molded into the material of the body.

Figure 7:
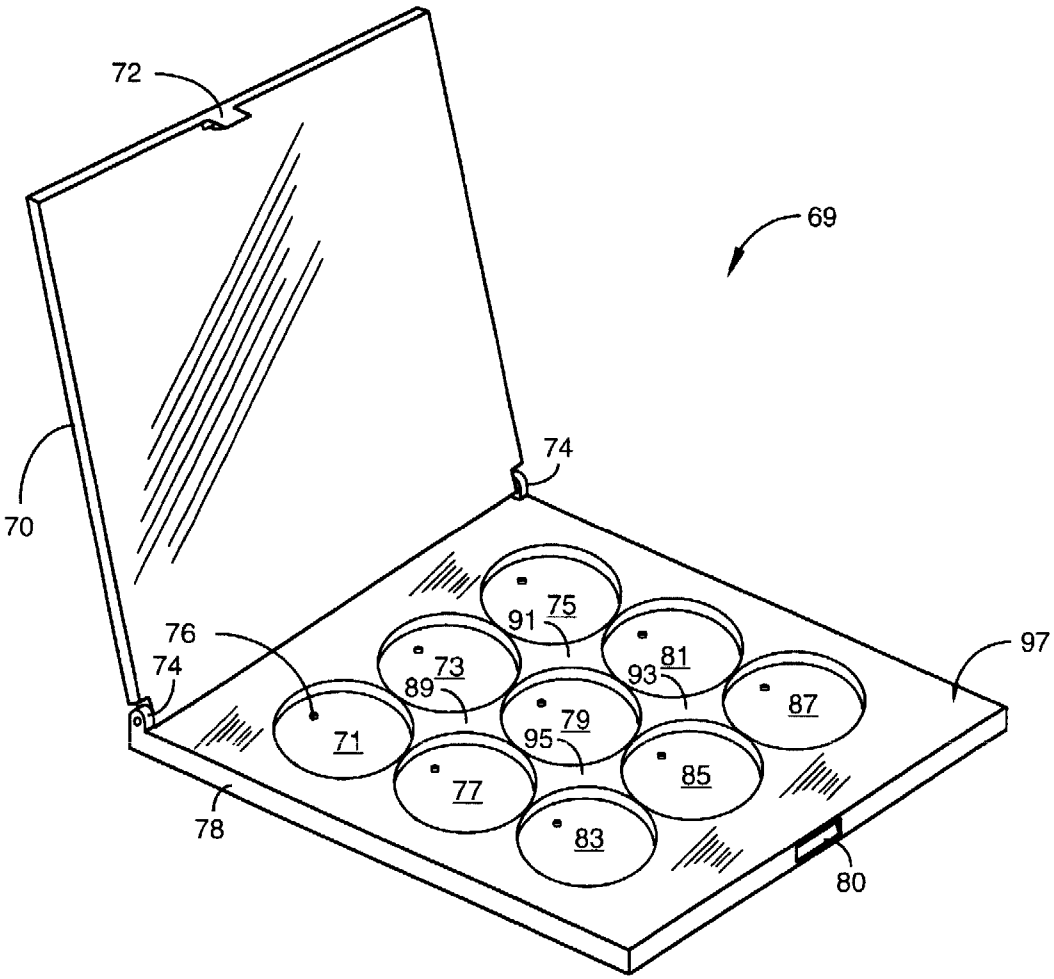
FIG. 7 is an isometric view of a display carrier according to an alternative embodiment of the present invention.

In an alternative embodiment of the present invention, only one level of POG positions is provided in a body for a display carrier, and the overall height (D1 of FIG. 2) may consequently be less. FIG. 7 is an isometric view of a carrier 69 having nine cavities 71, 73, 75, 77, 79, 81, 83, 85, and 87 for locating and displaying POGS. In this embodiment, the intervening areas between POG positions (areas 89, 91, 93, and 95) are provided with permanent pictorial elements, so the remaining elements providing a composite picture are provided by POG placement. In this embodiment, the out-side areas of upper surface 97 of the body may optionally also be provided with permanent pictorial elements.

Carrier 69 of FIG. 7 has a number of elements similar to elements of carrier 11 of FIG. 2. For example, transparent lid 70 with a molded clip 72 for engaging a molded depression 80 in body portion 78 is equivalent to transparent lid 15 and clip 61 of FIG. 2. Hinge projections 74 of FIG. 7 are equivalent to hinge projections 19 of FIG. 2. Locator pins 76 of FIG. 7 are equivalent to locator pins 65 of FIG. 2, and so forth.

As was described above, a transparent lid is provided to be closed over POGS placed in a display carrier according to the invention, and closing the lid provides security and protection for the POGS within, while also allowing the picture presented by the POGS to be displayed. Opening the lid provides access to the POGS for playing games incorporating the POGS.

Figure 8:
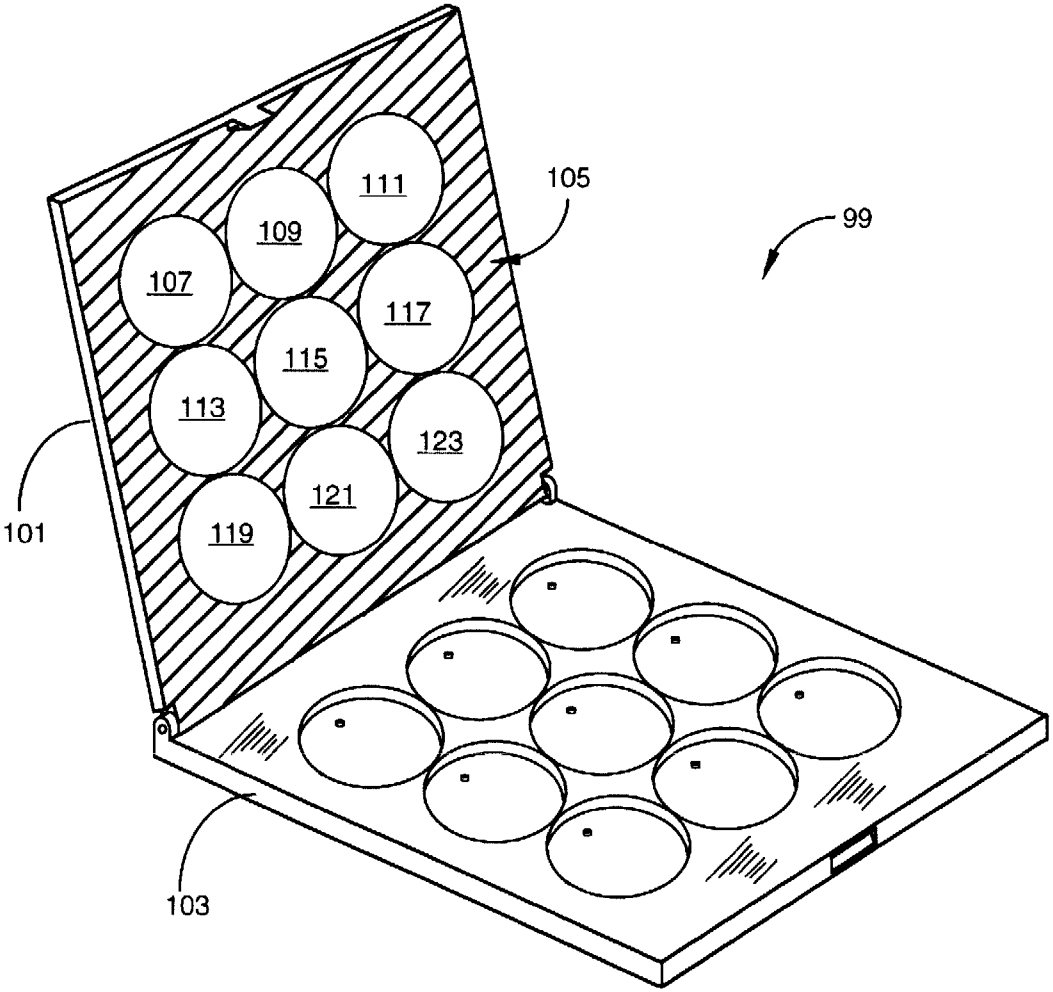
FIG. 8 is an isometric view of a display carrier according to yet another alternative embodiment of the present invention.

In yet another alternative embodiment, portions of a composite picture involving POGS in carrier positions is provided by attaching picture bearing elements to the underside of lid 15. FIG. 8 illustrates a carrier 99 much like the carrier shown in FIG. 7, having a single layer of POG positions. Carrier 99 has a lid 101 and a body 103. Body 103 has the cavities for POG positions. In carrier 99, there are no permanent picture elements affixed to the surfaces of body 103. Picture elements are affixed, however, to the underside 105 of lid 101 with the picture elements presented in the direction of and through the thickness of the transparent lid material so these permanent elements may be seen through the lid when the lid is closed over the body. In this embodiment, the permanent elements become a part of the overall picture only when the lid is closed over the body.

In FIG. 8, the shaded area on the underside of lid 101 may be a printed layer affixed by clear adhesive to the lid surface. Picture elements may also be painted or printed directly on the surface of the underside of the lid, bearing in mind that these elements must be provided in this embodiment to be viewed through the thickness of the transparent lid. Areas 107, 109, 111, 113, 115, 117, 119, 121, and 123 remain transparent in this embodiment so picture elements on POGS placed in the cavities in body 103 may be viewed through the lid, when the lid is closed, to form parts of an overall pictorial presentation with the picture elements on the underside of the lid.

In another variation, part of the permanent elements may be presented on the body, and another part on the underside of the lid. In yet another variation, permanent elements are presented on the body, so a complete composite picture is presented with the lid open, and other elements are provided on the underside of the lid to become a part of the overall composite picture when the lid is closed. The lid for example, might have a translucent color or hue, to add to the artistic effect, and might also have patterns and/or semi-transparent elements that become a part of the overall picture when the lid is closed.

It will be apparent to those with skill in the art that there are a broad variety of variations that might be made in the various embodiments described without departing materially from the spirit and scope of the invention. Many such variations have been described above. For example, although moldable plastic is preferred for fashioning the elements of the display carrier of the invention, there are many other materials and techniques that might be used. The body might be wood in one embodiment, and the lid made of glass or almost any other transparent material. In many cases, the material for the lid might depend to some extent on whether the lid is to be decorated somehow to become a part of the display rather than merely a protective element.

There are, as was described, a number of different ways hinges might be provided. And a hinge is certainly not absolutely required. Some carriers may have no lid, and others may have lids that snap on without hinges. Embodiments have been described with nine POGS and with thirteen POGS. Display carriers according to the invention, however, could certainly be made with fewer or more POGS, and in different sizes. And carriers might be made to display and form composite pictures with game and collectible elements other than POGS.

I claim:

1. A display carrier for round, flat articles having a common thickness T and a common diameter D, comprising:

a body portion with an upper flat surface having an array of round registration cavities therein, the registration cavities each having a diameter adapted to be at least equal to the common diameter D and each having a flat bottom surface parallel to the upper flat surface of the body portion, the registration cavities having a common depth between the upper flat surface and the bottom surface adapted to be equal to at least twice the common thickness T, and wherein all intermediate area between the registration cavities forms a flat planar surface parallel to the bottom surfaces of the registration cavities and to the upper flat surface of the body portion, at a distance from the upper flat surface of the body portion adapted to be at least equal to the common thickness T.

2. The display carrier of claim 1, wherein the array of round registration cavities forms a Cartesian array with circumferences of the round registration cavities tangential.

3. The display carrier of claim 1 further comprising positioning elements in the flat bottom surfaces of the registration cavities and in the intermediate area between the registration cavities, the positioning elements placed to cooperate with mating positioning elements on individual ones of the round flat articles, for orienting the round flat articles rotationally in the registration cavities.

4. The display carrier of claim 3 wherein the positioning elements are pins protruding from the flat bottom surfaces of the registration cavities and from the flat planar surface of the intermediate area between the registration cavities.

5. The display carrier of claim 1 in combination with the round flat articles which are selected from a group of elements including POGSs and Slammers.

6. A display carrier for round, flat articles, comprising:

a body portion with an upper flat surface having an array of round registration cavities therein, the registration cavities each having a common diameter D and each having a flat bottom surface parallel to the upper flat surface of the body portion, the registration cavities having a common depth between the upper flat surface and the bottom surface equal to at least twice a common thickness T, and wherein all intermediate area between the registration cavities forms a flat planar surface parallel to the bottom surfaces of the registration cavities and to the upper flat surface of the body portion, at a distance from the upper flat surface of the body portion equal to the common thickness T; and a lid portion formed of transparent material, the lid portion sized to overlay all of the upper flat surface of the body portion;

wherein the body portion and the lid portion have corresponding engagement elements enabling the lid portion to attach to and detach from the body portion.

7. The display carrier of claim 6 wherein the lid portion is hinged to the body portion.

8. The display carrier of claim 6, wherein the array of round registration cavities forms a Cartesian array with circumferences of the round registration cavities tangential.

9. The display carrier of claim 6 further comprising positioning elements in the flat bottom surfaces of the registration cavities and in the intermediate area between the registration cavities, the positioning elements placed to cooperate with mating positioning elements on individual ones of the round flat articles, for orienting the round flat articles rotationally in the registration cavities.

10. The display carrier of claim 9 wherein the positioning elements are pins protruding from the flat bottom surfaces of the registration cavities and from the flat planar surface of the intermediate area between the registration cavities.

11. The display carrier of claim 6 in combination with the round flat articles which are selected from a group of articles including POGSs and Slammers.

* * * * *